US007372967B2

(12) United States Patent
Henson et al.

(10) Patent No.: US 7,372,967 B2
(45) Date of Patent: May 13, 2008

(54) MICROPHONE BIAS CIRCUIT

(75) Inventors: Matthew Brady Henson, Austin, TX (US); Marcus W. May, Austin, TX (US); John Willis, Austin, TX (US)

(73) Assignee: Sigmatel, Inc., Austin, TX (US)

( * ) Notice: Subject to any disclaimer, the term of this patent is extended or adjusted under 35 U.S.C. 154(b) by 635 days.

(21) Appl. No.: 10/723,170

(22) Filed: Nov. 26, 2003

(65) Prior Publication Data

US 2004/0208327 A1 Oct. 21, 2004

Related U.S. Application Data

(60) Provisional application No. 60/429,941, filed on Nov. 29, 2002.

(51) Int. Cl.
*H04R 3/00* (2006.01)

(52) U.S. Cl. ..... 381/111; 381/113; 381/112; 381/122; 381/92

(58) Field of Classification Search ..... 381/111, 381/113, 92, 120, 122; 327/541; 326/30
See application file for complete search history.

(56) References Cited

U.S. PATENT DOCUMENTS 6,243,817 B1 * 6/2001 Melo et al. ..... 713/300
6,759,906 B2 * 7/2004 Matsunaga et al. ..... 330/285
2005/0276423 A1 * 12/2005 Aubauer et al. ..... 381/92

* cited by examiner

*Primary Examiner*—Vivian Chin
*Assistant Examiner*—Disler Paul
(74) *Attorney, Agent, or Firm*—Garlick, Harrison & Markison; Timothy W. Markison

(57) ABSTRACT

A microphone bias circuit includes a first integrated circuit (IC) pin, a second IC pin, a first resistor, and a variable supply voltage buffer. The first resistor is operably coupled to the first IC pin and a return voltage. The second IC pin is operably coupled to receive analog signals from a microphone. The variable supply voltage buffer is operably coupled to produce a buffered supply voltage based on a variable impedance setting, wherein at least one off-chip component couples the second IC pin to the first IC pin and wherein the variable supply voltage buffer provides the buffered supply voltage to second IC pin as a microphone bias voltage.

14 Claims, 3 Drawing Sheets microphone bias 60 multi-function handheld device 40 microphone bias 60

MICROPHONE BIAS CIRCUIT

CROSS REFERENCE TO RELATED PATENTS

This patent application is claiming priority under 35 USC § 119 to provisionally filed patent application entitled MULTI-FUNCTION HANDHELD DEVICE, having a provisional Ser. No. of 60/429,941, and a filing date of Nov. 29, 2002.

BACKGROUND OF THE INVENTION

1. Technical Field of the Invention

This invention relates generally to portable electronic equipment and more particularly to a multi-function handheld device.

2. Description of Related Art

As is known, integrated circuits are used in a wide variety of electronic equipment, including portable, or handheld, devices. Such handheld devices include personal digital assistants (PDA), CD players, MP3 players, DVD players, AM/FM radio, a pager, cellular telephones, computer memory extension (commonly referred to as a thumb drive), etc. Each of these handheld devices includes one or more integrated circuits to provide the functionality of the device. For example, a thumb drive may include an integrated circuit for interfacing with a computer (e.g., personal computer, laptop, server, workstation, etc.) via one of the ports of the computer (e.g., Universal Serial Bus, parallel port, etc.) and at least one other memory integrated circuit (e.g., flash memory). As such, when the thumb drive is coupled to a computer, data can be read from and written to the memory of the thumb drive. Accordingly, a user may store personalized information (e.g., presentations, Internet access account information, etc.) on his/her thumb drive and use any computer to access the information.

As another example, an MP3 player may include multiple integrated circuits to support the storage and playback of digitally formatted audio (i.e., formatted in accordance with the MP3 specification). As is known, one integrated circuit may be used for interfacing with a computer, another integrated circuit for generating a power supply voltage, another for processing the storage and/or playback of the digitally formatted audio data, and still another for rendering the playback of the digitally formatted audio data audible.

As is also known, many handheld devices include an input port that connects to a microphone such that audio inputs may be received and subsequently recorded (i.e., stored in a digital format). To facilitate the digital storing of audio input signals, at least one integrated circuit of the handheld device includes a microphone input pin that is coupled to receive the audio signals via the input port. The microphone input pin is biased via an on-chip microphone biasing circuit that establishes an AC ground for the analog input signals. The biased analog signals are then converted to digital signals, which may be stored in this format or converted to another format (e.g., pulse code modulation).

An issue with the on-chip microphone biasing circuit is that, since it typically includes a resistive divider network coupled to the power supply of the integrated circuit, it injects power supply noise into the biased analog signals. The injection of power supply noise, or any other noise, into the analog signals limits the signal quality as it is converted to digital signals. Further, such a resistive divider network microphone biasing circuit constantly consumes power, which for a battery operated handheld device, is detrimental.

Therefore, a need exists for a microphone bias circuit that reduces noise injected into analog input signals.

BRIEF SUMMARY OF THE INVENTION

The microphone bias circuit of the present invention substantially meets these needs and others. In one embodiment, a microphone bias circuit includes a first integrated circuit (IC) pin, a second IC pin, a first resistor, and a variable supply voltage buffer. The first resistor is operably coupled to the first IC pin and a return voltage. The second IC pin is operably coupled to receive analog signals from a microphone. The variable supply voltage buffer is operably coupled to produce a buffered supply voltage based on a variable impedance setting, wherein at least one off-chip component couples the second IC pin to the first IC pin and wherein the variable supply voltage buffer provides the buffered supply voltage to second IC pin as a microphone bias voltage.

DETAILED DESCRIPTION OF THE INVENTION

Figure 1:
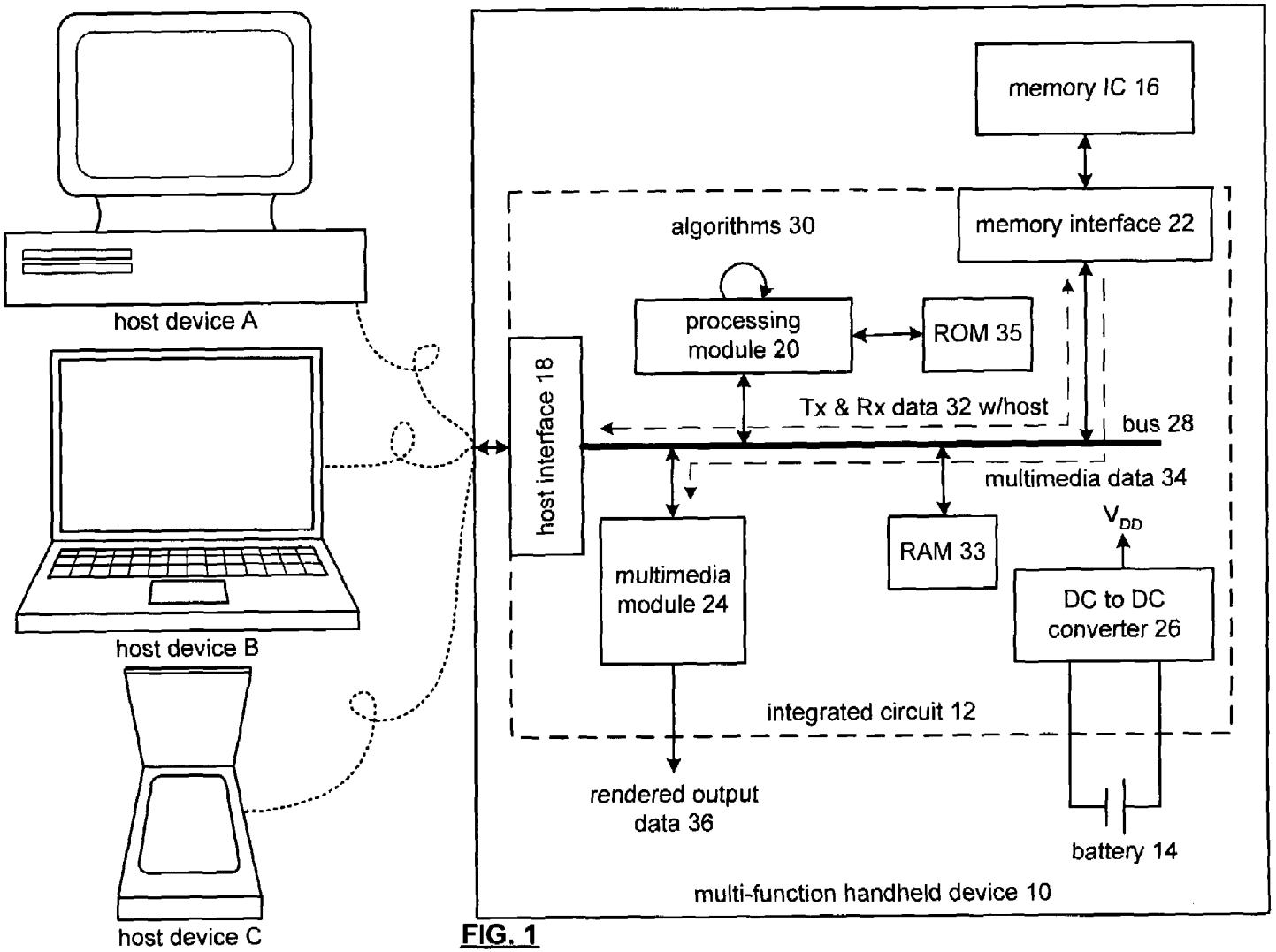
FIG. 1 is a schematic block diagram of a multiple function handheld device in accordance with an embodiment of the present invention.

FIG. 1 is a schematic block diagram of a multi-function handheld device 10 coupled to a host device A, B, or C. The multi-function handheld device 10 includes an integrated circuit 12, a memory integrated circuit (IC) 16, and a battery 14. The integrated circuit 12 includes a host interface 18, a processing module 20, a memory interface 22, a multimedia module 24, a DC-to-DC converter 26, and a bus 28. The multimedia module 24 alone or in combination with the processing module 20 provides the functional circuitry for the integrated circuit 12. The DC-to-DC converter 26, which may be constructed in accordance with the teaching of U.S. Pat. No. 6,204,651, entitled METHOD AND APPARATUS FOR REGULATING A DC VOLTAGE, provides at least a first supply voltage to one or more of the host interface 18, the processing module 20, the multimedia module 24, and the memory interface 22. The DC-to-DC converter 26 may also provide $V_{DD}$ to one or more of the other components of the handheld device 10.

When the multi-function handheld device 10 is operably coupled to a host device A, B, or C, which may be a personal computer, workstation, server (which are represented by host device A), a laptop computer (host device B), a personal digital assistant (host device C), and/or any other device that may transceive data with the multi-function handheld device, the processing module 20 performs at least one algorithm 30, where the corresponding operational instructions of the algorithm 30 are stored in memory 16 and/or in memory incorporated in the processing module 20. The processing module 20 may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on operational instructions. The associated memory may be a single memory device or a plurality of memory devices. Such a memory device may be a read-only memory, random access memory, volatile memory, non-volatile memory, static memory, dynamic memory, flash memory, and/or any device that stores digital information. Note that when the processing module 20 implements one or more of its functions via a state machine, analog circuitry, digital circuitry, and/or logic circuitry, the associated memory storing the corresponding operational instructions is embedded with the circuitry comprising the state machine, analog circuitry, digital circuitry, and/or logic circuitry.

With the multi-function handheld device 10 in the first functional mode, the integrated circuit 12 facilitates the transfer of data between the host device A, B, or C and memory 16, which may be non-volatile memory (e.g., flash memory, disk memory, SDRAM) and/or volatile memory (e.g., DRAM). In one embodiment, the memory IC 16 is a NAND flash memory that stores both data and the operational instructions of at least some of the algorithms 30. The interoperability of the memory IC 16 and the integrated circuit 12 will be described in greater detail with reference to FIGS. 15-17.

In this mode, the processing module 30 retrieves a first set of operational instructions (e.g., a file system algorithm, which is known in the art) from the memory 16 to coordinate the transfer of data. For example, data received from the host device A, B, or C (e.g., Rx data) is first received via the host interface module 18. Depending on the type of coupling between the host device and the handheld device 10, the received data will be formatted in a particular manner. For example, if the handheld device 10 is coupled to the host device via a USB cable, the received data will be in accordance with the format proscribed by the USB specification. The host interface module 18 converts the format of the received data (e.g., USB format) into a desired format by removing overhead data that corresponds to the format of the received data and storing the remaining data as data words. The size of the data words generally corresponds directly to, or a multiple of, the bus width of bus 28 and the word line size (i.e., the size of data stored in a line of memory) of memory 16. Under the control of the processing module 20, the data words are provided, via the memory interface 22, to memory 16 for storage. In this mode, the handheld device 10 is functioning as extended memory of the host device (e.g., like a thumb drive).

In furtherance of the first functional mode, the host device may retrieve data (e.g., Tx data) from memory 16 as if the memory were part of the computer. Accordingly, the host device provides a read command to the handheld device, which is received via the host interface 18. The host interface 18 converts the read request into a generic format and provides the request to the processing module 20. The processing module 20 interprets the read request and coordinates the retrieval of the requested data from memory 16 via the memory interface 22. The retrieved data (e.g., Tx data) is provided to the host interface 18, which converts the format of the retrieved data from the generic format of the handheld device into the format of the coupling between the handheld device and the host device. The host interface 18 then provides the formatted data to the host device via the coupling.

The coupling between the host device and the handheld device may be a wireless connection or a wired connection. For instance, a wireless connection may be in accordance with Bluetooth, IEEE 802.11(a), (b) or (g), and/or any other wireless LAN (local area network) protocol, IrDA, etc. The wired connection may be in accordance with one or more Ethernet protocols, Firewire, USB, etc. Depending on the particular type of connection, the host interface module 18 includes a corresponding encoder and decoder. For example, when the handheld device 10 is coupled to the host device via a USB cable, the host interface module 18 includes a USB encoder and a USB decoder.

As one of average skill in the art will appreciate, the data stored in memory 16, which may have 64 Mbytes or greater of storage capacity, may be text files, presentation files, user profile information for access to varies computer services (e.g., Internet access, email, etc.), digital audio files (e.g., MP3 files, WMA—Windows Media Architecture—, MP3 PRO, Ogg Vorbis, AAC—Advanced Audio Coding), digital video files [e.g., still images or motion video such as MPEG (motion picture expert group) files, JPEG (joint photographic expert group) files, etc.], address book information, and/or any other type of information that may be stored in a digital format. As one of average skill in the art will further appreciate, when the handheld device 10 is coupled to the host device A, B, or C, the host device may power the handheld device 10 such that the battery is unused.

When the handheld device 10 is not coupled to the host device, the processing module 20 executes an algorithm 30 to detect the disconnection and to place the handheld device in a second operational mode. In the second operational mode, the processing module 20 retrieves, and subsequently executes, a second set of operational instructions from memory 16 to support the second operational mode. For example, the second operational mode may correspond to MP3 file playback, digital dictaphone recording, MPEG file playback, JPEG file playback, text messaging display, cellular telephone functionality, and/or AM/FM radio reception. Each of these functions is known in the art, thus no further discussion of the particular implementation of these functions will be provided except to further illustrate the concepts of the present invention.

In the second operational mode, under the control of the processing module 20 executing the second set of operational instructions, the multimedia module 24 retrieves multimedia data 34 from memory 16. The multimedia data 34 includes at least one of digitized audio data, digital video data, and text data. Upon retrieval of the multimedia data, the multimedia module 24 converts the data 34 into rendered output data 36. For example, the multimedia module 24 may convert digitized data into analog signals that are subsequently rendered audible via a speaker or via a headphone jack. In addition, or in the alternative, the multimedia module 24 may render digital video data and/or digital text data into RGB (red-green-blue), YUV, etc., data for display on an LCD (liquid crystal display) monitor, projection CRT, and/or on a plasma type display.

As one of average skill in the art, the handheld device 10 may be packaged similarly to a thumb drive, a cellular telephone, pager (e.g., text messaging), a PDA, an MP3 player, a radio, and/or a digital dictaphone and offer the corresponding functions of multiple ones of the handheld devices (e.g., provide a combination of a thumb drive and MP3 player/recorder, a combination of a thumb drive, MP3 player/recorder, and a radio, a combination of a thumb drive, MP3 player/recorder, and a digital dictaphone, combination of a thumb drive, MP3 player/recorder, radio, digital dictaphone, and cellular telephone, etc.).

Figure 2:
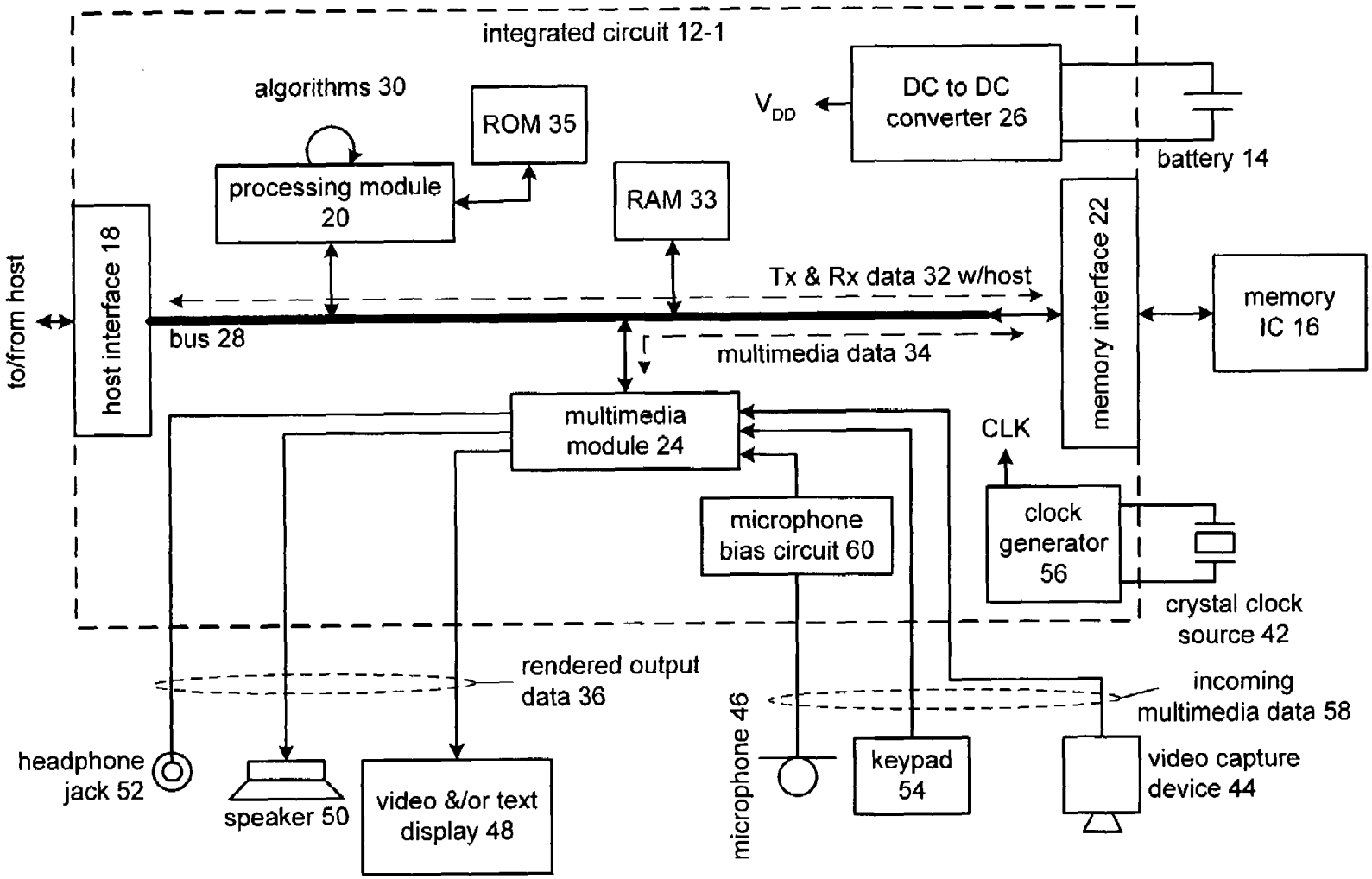
FIG. 2 is a schematic block diagram of a multiple function handheld device in accordance with another embodiment of the present invention.

FIG. 2 is a schematic block diagram of another handheld device 40 and a corresponding integrated circuit 12-1. In this embodiment, the handheld device 40 includes the integrated circuit 12-1, the battery 14, the memory 16, a crystal clock source 42, one or more multimedia input devices (e.g., one or more video capture device(s) 44, keypad(s) 54, microphone(s) 46, etc.), and one or more multimedia output devices (e.g., one or more video and/or text display(s) 48, speaker(s) 50, headphone jack(s) 52, etc.). The integrated circuit 12-1 includes the host interface 18, the processing module 20, the memory interface 22, the multimedia module 24, the DC-to-DC converter 26, a microphone bias circuit 60, and a clock generator 56, which produces a clock signal (CLK) for use by the other modules. As one of average skill in the art will appreciate, the clock signal CLK may include multiple synchronized clock signals at varying rates for the various operations of the multi-function handheld device.

Handheld device 40 functions in a similar manner as handheld device 10 when exchanging data with the host device (i.e., when the handheld device is in the first operational mode). In addition, while in the first operational mode, the handheld device 40 may store digital information received via one of the multimedia input devices 44, 46, and 54. For example, a voice recording received via the microphone 46 may be provided as multimedia input data 58, digitized via the multimedia module 24 and digitally stored in memory 16. Similarly, video recordings may be captured via the video capture device 44 (e.g., a digital camera, a camcorder, VCR output, DVD output, etc.) and processed by the multimedia module 24 for storage as digital video data in memory 16. Further, the key pad 54 (which may be a keyboard, touch screen interface, or other mechanism for inputting text information) provides text data to the multimedia module 24 for storage as digital text data in memory 16. In this extension of the first operational mode, the processing module 20 arbitrates write access to the memory 16 among the various input sources (e.g., the host and the multimedia module).

When the handheld device 40 is in the second operational mode (i.e., not connected to the host), the handheld device may record and/or playback multimedia data stored in the memory 16. Note that the data provided by the host when the handheld device 40 was in the first operational mode includes the multimedia data. The playback of the multimedia data is similar to the playback described with reference to the handheld device 10 of FIG. 1. In this embodiment, depending on the type of multimedia data 34, the rendered output data 36 may be provided to one or more of the multimedia output devices. For example, rendered audio data may be provided to the headphone jack 52 an/or to the speaker 50, while rendered video and/or text data may be provided to the display 48.

The handheld device 40 may also record multimedia data 34 while in the second operational mode. For example, the handheld device 40 may store digital information received via one of the multimedia input devices 44, 46, and 54.

Figure 3:
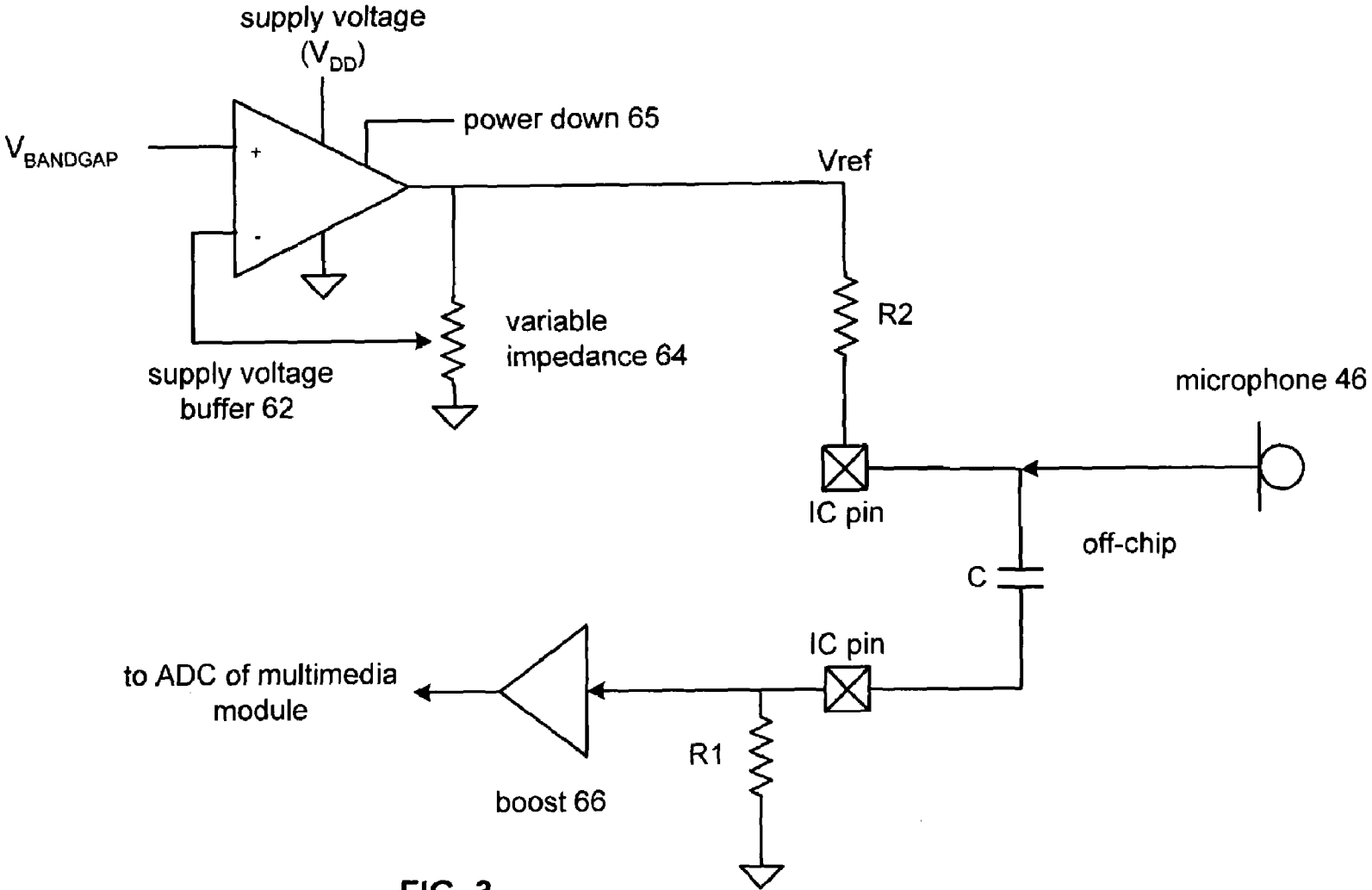
FIG. 3 is a schematic block diagram of a microphone bias circuit in accordance with an embodiment of the present invention.

FIG. 3 is a schematic block diagram of a microphone bias circuit 60 that includes a supply voltage buffer 62, a first resistor (R1), a second resistor (R2), an off-chip capacitor (C), a first IC pin, a second IC pin, and a boost amplifier 66. The supply voltage buffer 62 includes an amplifier and a variable impedance 64 to produce an adjustable reference voltage (Vref) that is supplied as a microphone bias voltage to the second IC pin. The adjustable reference voltage may be adjusted by varying the input bandgap voltage (Vbandgap) and/or by varying the variable impedance 64, which may be an on-chip resistor network. The off-chip capacitor C couples the first IC pin to the second IC pin, which receives analog signals from the microphone 46. Note that the processing module 20, while executing an algorithm 30, may monitor the analog signals from the microphone 46 to determine whether they are optimally biased (e.g., approximately half way between a maximum voltage and a minimum voltage). If the analog signals are not optimally biased, the processing module adjusts the bandgap voltage and/or the adjustable impedance 46.

As shown, the microphone bias circuit 60 isolates the microphone bias voltage from the power supply noise of the supply voltage. As such, less noise is injected in the analog signals received via the microphone 46. Thus, a low noise analog signal is amplified via the boost amplifier 66, prior to being provided to an analog to digital converter within the multimedia module 24. Further, by including a power down 65 input to the supply voltage buffer 62, the microphone bias circuit 60 may be powered down when it is not needed to conserve power.

As one of average skill in the art will appreciate, the term "substantially" or "approximately", as may be used herein, provides an industry-accepted tolerance to its corresponding term. Such an industry-accepted tolerance ranges from less than one percent to twenty percent and corresponds to, but is not limited to, component values, integrated circuit process variations, temperature variations, rise and fall times, and/or thermal noise. As one of average skill in the art will further appreciate, the term "operably coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. As one of average skill in the art will also appreciate, inferred coupling (i.e., where one element is coupled to another element by inference) includes direct and indirect coupling between two elements in the same manner as "operably coupled". As one of average skill in the art will further appreciate, the term "compares favorably", as may be used herein, indicates that a comparison between two or more elements, items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

The preceding discussion has presented a microphone bias circuit that reduces noise injected into analog signals received from a microphone. As one of average skill in the art will appreciate, other embodiments may be derived from the teachings of the present invention without deviating from the scope of the claims.

What is claimed is:

1. A microphone bias circuit for use within an integrated circuit having a microphone input, the microphone bias circuit comprises:

a first integrated circuit (IC) pin;

a first resistor operably coupled to the first IC pin and a return voltage;

a second IC pin operably coupled to receive analog signals from a microphone; and a variable supply voltage buffer operably coupled to produce a buffered supply voltage based on a variable impedance setting, wherein at least one off-chip component couples the second IC pin to the first IC pin and wherein the variable supply voltage buffer provides the buffered supply voltage to second IC pin as a microphone bias voltage.

2. The microphone bias circuit of claim 1, wherein the power supply buffer comprises:

an amplifier having a first input, a second input, and an output, wherein the first input is coupled to receive a bandgap voltage and the output provides the buffered supply voltage; and a variable impedance having a first node, a second node, and a tap node, wherein the first node is coupled to the output of the amplifier, the second node is coupled to the return voltage, and the tap node is coupled to the second input of the amplifier.

3. The microphone bias circuit of claim 2, wherein the variable impedance comprises an on-chip variable resistor circuit.

4. The microphone bias circuit of claim 1, wherein the at least one off-chip component comprises a capacitor.

5. The microphone bias circuit of claim 1 further comprises:

a second resistor coupled between the variable supply voltage buffer and the second IC pin.

6. The microphone bias circuit of claim 1 further comprises:

a processing module; and memory operably coupled to the processing module, wherein the memory stores operational instructions that cause the processing module to:

monitor the received analog signals;

determine whether the received analog signals are optimally biased; and when the received analog signals are not optimally biased, adjust the variable supply voltage buffer to optimally bias the received analog signals.

7. The microphone bias circuit of claim 1, wherein the supply voltage buffer comprises:

a power down input operably coupled to receive a power down signal, wherein, when the power down signal is in a first state, the supply voltage buffer is enabled and when the power down signal is in a second state, the supply voltage buffer is disabled.

8. An integrated circuit for use in a multiple function handheld device, the integrated circuit comprises:

a processing module operably coupled to perform at least one algorithm relating to a function of the multiple function handheld device;

an analog to digital converter operably coupled to convert analog signals into digital signals, wherein the digital signals are processed by the processing module while performing the at least one algorithm;

a microphone input circuit operably coupled to provide the analog signals to the analog to digital converter, wherein the microphone input circuit includes:

an amplifier operably coupled to amplify received input analog signals to produce the analog signals; and a microphone bias circuit that includes:

a first integrated circuit (IC) pin;

a first resistor operably coupled to the first IC pin and a return voltage;

a second IC pin operably coupled to receive analog signals from a microphone; and a variable supply voltage buffer operably coupled to produce a buffered supply voltage based on a variable impedance setting, wherein at least one off-chip component couples the second IC pin to the first IC pin and wherein the variable supply voltage buffer provides the buffered supply voltage to second IC pin as a microphone bias voltage.

9. The integrated circuit of claim 8, wherein the power supply buffer comprises:

an amplifier having a first input, a second input, and an output, wherein the first input is coupled to receive a bandgap voltage and the output provides the buffered supply voltage; and a variable impedance having a first node, a second node, and a tap node, wherein the first node is coupled to the output of the amplifier, the second node is coupled to the return voltage, and the tap node is coupled to the second input of the amplifier.

10. The integrated circuit of claim 9, wherein the variable impedance comprises an on-chip variable resistor circuit.

11. The integrated circuit of claim 8, wherein the at least one off-chip component comprises a capacitor.

12. The integrated circuit of claim 8, wherein the microphone bias circuit further comprises:

a second resistor coupled between the variable supply voltage buffer and the second IC pin.

13. The integrated circuit of claim 8, wherein the processing module further functions to:

monitor the received analog signals;

determine whether the received analog signals are optimally biased; and when the received analog signals are not optimally biased, adjust the variable supply voltage buffer to optimally bias the received analog signals.

14. The integrated circuit of claim 8, wherein the supply voltage buffer comprises:

a power down input operably coupled to receive a power down signal, wherein, when the power down signal is in a first state, the supply voltage buffer is enabled and when the power down signal is in a second state, the supply voltage buffer is disabled.

* * * * *